US006420014B1

(12) United States Patent
Hartman

(10) Patent No.: US 6,420,014 B1
(45) Date of Patent: Jul. 16, 2002

(54) Z-SHAPED SHEET PILING

(75) Inventor: Richard J. Hartman, Clarence, NY (US)

(73) Assignees: L. B. Foster Company, Pittsburgh, PA (US); Chaparral Steel Company, Dallas, TX (US)

( * ) Notice: Subject to any disclaimer, the term of this patent is extended or adjusted under 35 U.S.C. 154(b) by 0 days.

(21) Appl. No.: 09/473,757

(22) Filed: Dec. 28, 1999

(51) Int. Cl.[7] ..... B32B 1/00; E04C 3/30; E02D 5/02

(52) U.S. Cl. ..... 428/156; 428/174; 405/274; 405/276; 52/724.1; 52/726.1; 52/730.6

(58) Field of Search ..... 428/33, 57, 174, 428/212, 219, 340, 156, 121, 130; 52/579, 730.6, 724.1, 726.1, 730.1; 405/274, 276, 281

(56) References Cited

U.S. PATENT DOCUMENTS 6,042,306 A * 3/2000 Arndts et al. ..... 405/279
6,106,201 A * 8/2000 Bourdouxhe ..... 405/281

OTHER PUBLICATIONS

Wayne C. Teng, Foundation Design, 1962 (prior to effective filing date) pp. 347–407.

Hsai_Yand Fang, Foundation Engineering Handbook, Second Edition, 1991 (prior to effective filing date) pp. 447–472.

Goldberg, Jaworski, Gordon, Lateral Support Systems and Underpinning, 1976 (prior to effective filing date) pp. 128–133.

Gregory P. Tschebotarioff, Soil Mechanics, Foundations, and Earth Structures, McGraw–Hill Book Company, Inc., 1957 (prior to effective filing date) pp. 457–462.

United States Steel Steel Sheet Piling Design Manual, 1969 (prior to effective filing date).

Pile Buck, Inc., Steel Sheet Piling Specifications, 1995 (prior to effective filing date).

D.C. Krouse, Task Group on Sheet Piling, Mar. 19, 1986.

Richard J. Hartman and John A. Neal, Summary Excerpted from Report of Investigation and Test Program Related to Behavior of Steel Sheet Piling Subjected to Hydrostatic Test Loading, Jun. 29, 1992.

Bethlehem Steel, Bethlehem Steel Sheet Piling, current through Nov. 1995.

(List continued on next page.)

*Primary Examiner*—Donald J. Loney
(74) *Attorney, Agent, or Firm*—Phillips, Lytle, Hitchcock, Blaine & Huber LLP

(57) ABSTRACT

This invention is directed to an improved Z-shaped sheet piling (15). In the preferred embodiment, the piling has a first flange (16), a web (19), a second flange (18), a section modulus of at least about 25 in.$^3$/ft., a weight of less than about 31 lbs./ft.$^2$, the second flange having a wale location (68), and the web, first flange and second flange being so dimensioned and configured that the transverse stress at the wale location for each psi of applied pressure load is less than about 1000 psi. The present invention also discloses a Z-shaped sheet piling in which the first flange has a span location (65) and the first flange, web, and second flange are so dimensioned and configured that the transverse stress at the span location for each psi of applied load is less than about 800 psi. The transverse stress at the wale location may be about 878 psi per psi of applied load and the transverse stress at the span location may be about 731 psi per psi of applied load or about 786 psi per psi of applied load. The piling may have a moment of inertia of about 188.66 in.$^4$/ft., may have a section modulus of about 30.97 in.$^3$/ft., may weight about 27.56 psf, and may have a cross-sectional area of about 12 in.$^2$.

9 Claims, 10 Drawing Sheets

OTHER PUBLICATIONS

Richard J Hartman and John A. Neal, Report of Investigation of the Effect of Transverse Loads on the Behavior of Z–Shaped Steel Sheet Piling, Mar. 26, 1997.

Nvcor–Yamato Steel Company, Nucor–Yamato Steel's PZ22 and PZ27 Steel Sheet Piling, advertised prior to earliest filing dated of Dec. 28, 1998.

* cited by examiner

NOTE: The upper portions of the lines are truncated at $M_L$ = 0.65$f_y$ (Section Modulus)

Z-SHAPED SHEET PILING

FIELD OF THE INVENTION

The present invention relates generally to the field of sheet pilings, and, more particularly, to an improved sheet piling having a substantially Z-shaped transverse cross section.

BACKGROUND ART

A variety of Z-shaped steel sheet pilings are known in the prior art. Z-shaped sheet pilings are typically produced in a number of different sizes, each characterized by its approximate weight in pounds per square foot ("psf"). Typical sizes include the PZ22, PLZ23, PLZ25, PZ27, PZ35, and the PZ40. One of the most widely used sheet piling is the PZ27. Such sheet pilings were widely produced by Bethlehem Steel Corporation and United States Steel Corporation. The PZ22 and PZ27 sections are now produced by Nucor-Yamato.

However, the strength criteria previously used to design the cross section of Z-shaped sheet piling was based on the section modulus of the piling. The cross-sectional design for the Z-shaped sheet piling did not incorporate or take into account transverse stresses; i.e., those stresses oriented perpendicularly to the longitudinal axis of the sheet piling. Consequently, known Z-shaped sheet pilings did not have great resistance to transverse loading.

Hence, it would be useful to provide a Z-shaped sheet piling in which the cross-sections are designed so as to resist transverse stresses.

DISCLOSURE OF THE INVENTION

With parenthetical reference to the corresponding parts, portions or surfaces of the disclosed embodiment, merely for the purposes of illustration and not by way of limitation, the present invention provides an improved Z-shaped sheet piling (15) having a first flange (16), a web (19), a second flange (18), a section modulus of at least about 25 $in^3$/ft., a weight of less than about 31 lbs./$ft.^2$, and the second flange having a wale location (68). The improvement comprises the web, first flange and second flange being so dimensioned and configured that the transverse stress at the wale location for each psi of applied load is less than about 1000 pounds per square inch ("psi"). The transverse stress at the wale location may be about 878 psi per psi of applied pressure load.

The present invention also provides a Z-shaped sheet piling having a first flange, a web and a second flange, the first flange having a span location (65 or 66). The improvement comprises the web, first flange and second flange being so dimensioned and configured that the transverse stress at the span location for each psi of applied load is less than about 800 psi. The transverse stress at the span location may be about 731 psi per psi of applied load or may be about 786 psi per psi of applied load.

The Z-shaped sheet piling may have a moment of inertia of about 188.66 $in.^4$/ft. The Z-shaped sheet piling may have a section modulus of about 30.97 $in^3$/ft., may have a weight of about 27.56 psf, and may have a cross-sectional area of about 12 $in^2$.

Accordingly, the general object of the present invention is to provide an improved Z-shaped sheet piling which is able to accommodate transverse stresses.

Another object is to provide an improved Z-shape sheet piling which has greater margins of safety when in use.

Another object is to provide an improved Z-shaped sheet piling which takes into account the transverse stresses when in actual use.

Another object is to provide a Z-shaped sheet piling which has a weight of about 27 psf.

Another object is to provide a Z-shaped sheet piling which is stronger at those points where it is necessary to resist transverse stresses.

Another object is to provide a Z-shaped sheet piling which reduces the deleterious stress.

DESCRIPTION OF THE PREFERRED EMBODIMENTS

Figure 1:
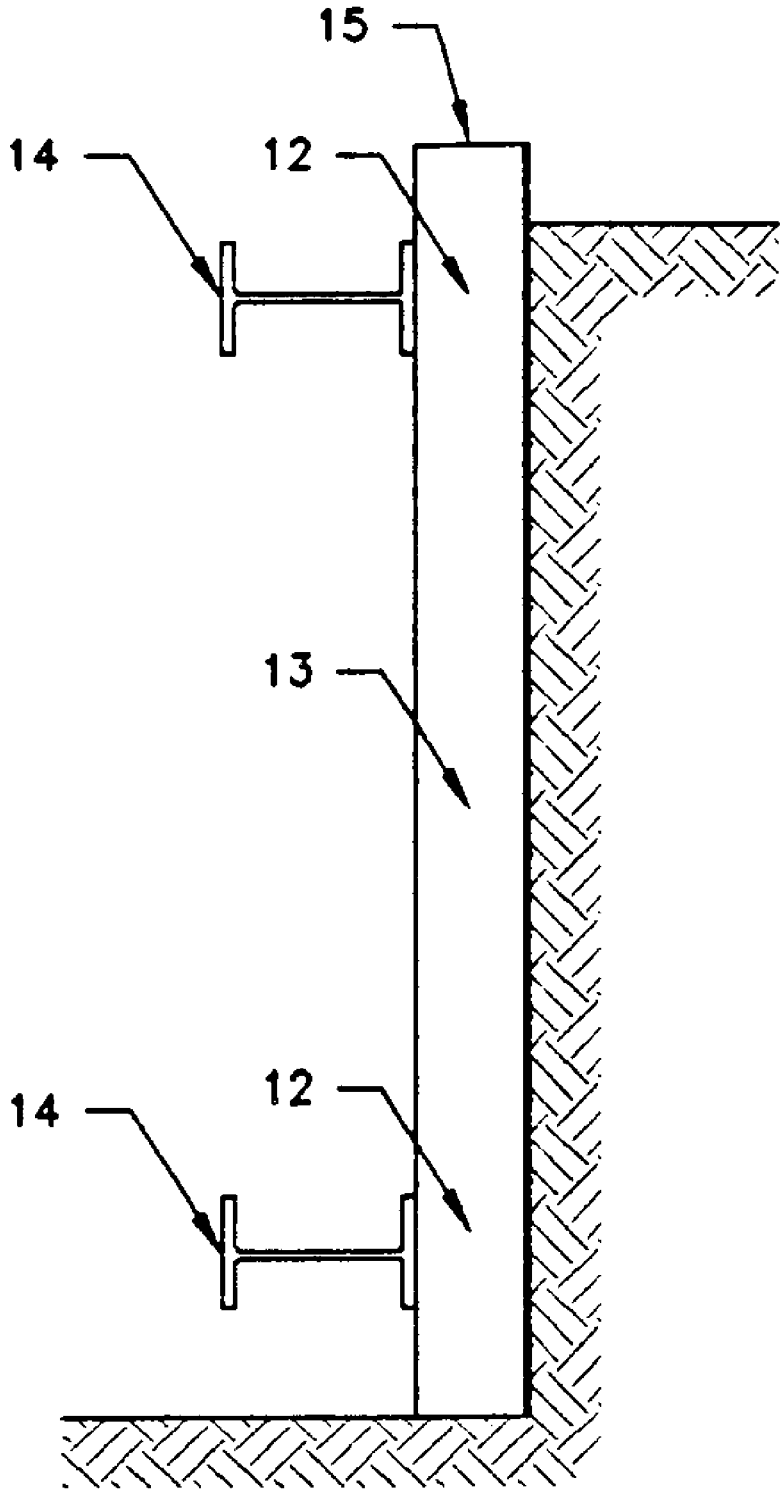
FIG. 1 is an elevation of the improved sheet piling under loading conditions.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, debris, etc.) together with the specification, and are to be considered a portion of the entire written description of this invention. As used in the following description, the terms "horizontal", "vertical", "left", "right", "up" and "down", as well as adjectival and adverbial derivatives thereof, (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Figure 3:
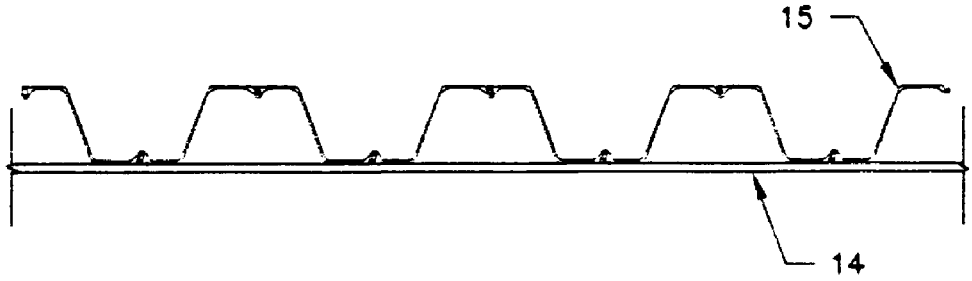
FIG. 3 is a plan view of the improved sheet piling shown in FIG. 1.
Figure 4:
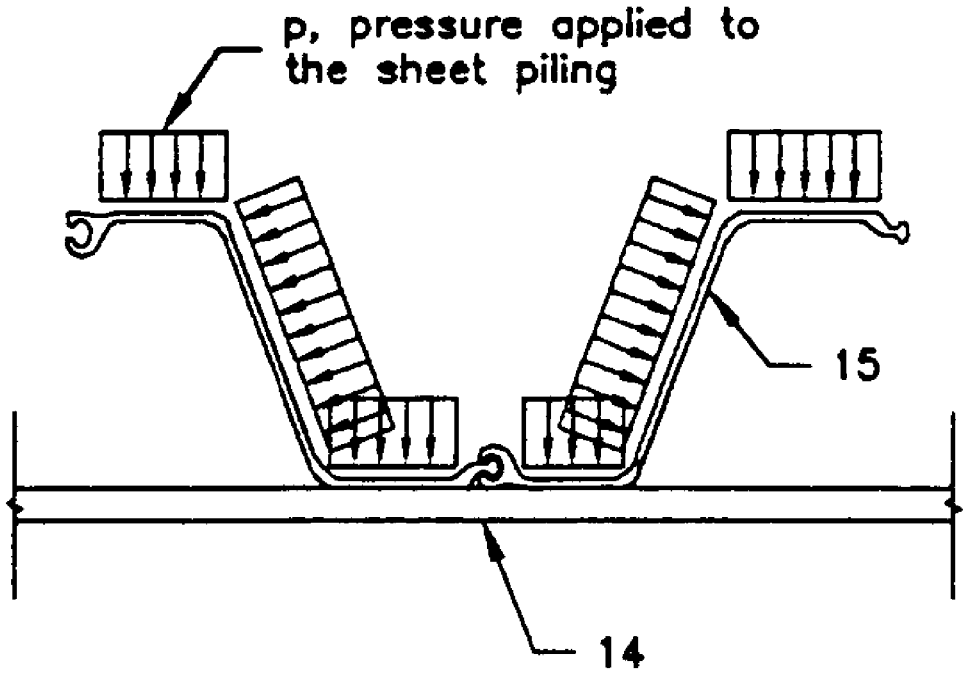
FIG. 4 is an exploded view of a portion of the sheet piling shown in FIG. 3.
Figure 5:
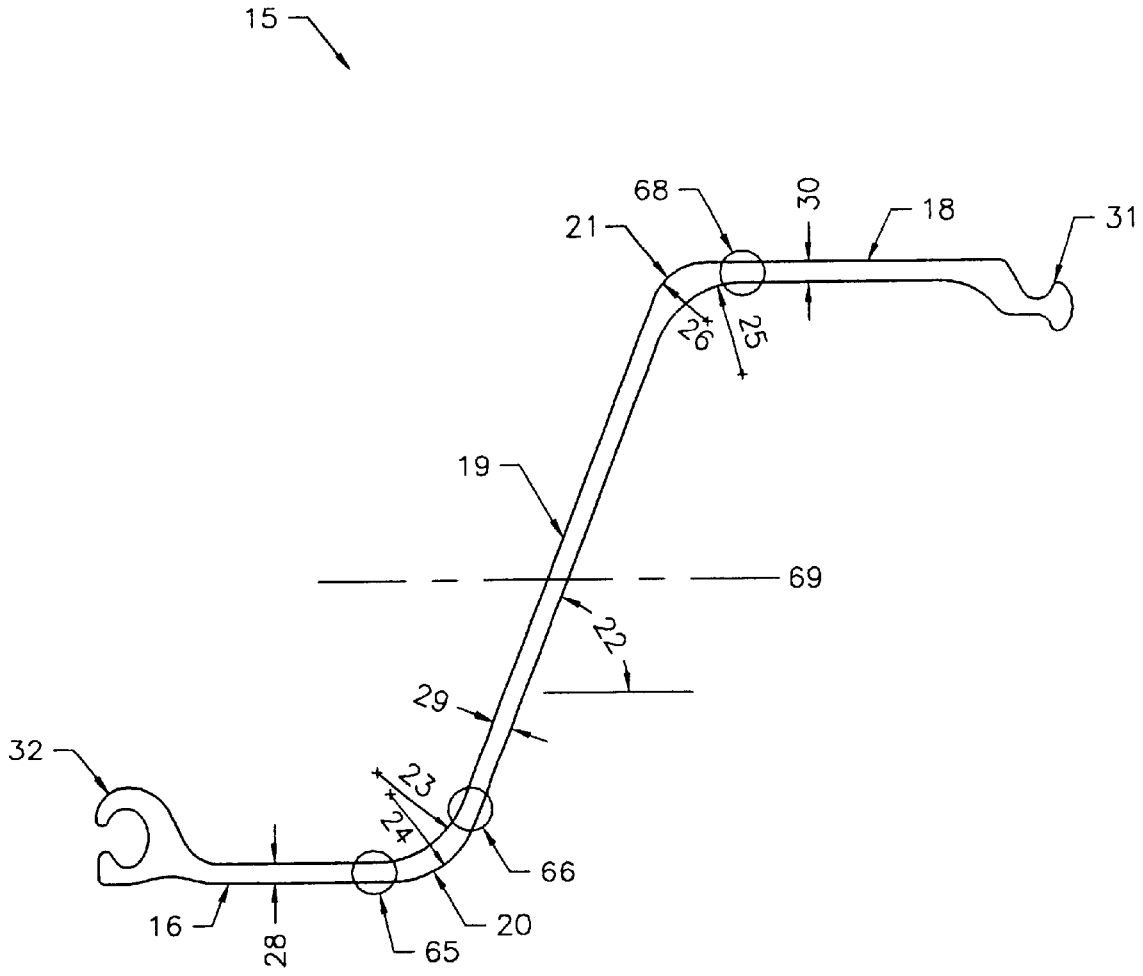
FIG. 5 is a transverse horizontal sectional view of the sheet piling shown in FIG. 1.

Referring now to the drawings, and, more particularly, to FIG. 1 thereof, this invention provides an improved Z-shaped sheet piling, of which the presently preferred embodiment is generally indicated at 15. As shown in FIG. 5, the improved sheet piling 15 broadly includes a first flange 16, a web 19, and a second flange 18. The left marginal end of flange 16 is provided with a socket connection 32. The right marginal end of second flange 18 is provided with a ball connection 31. As shown in FIGS. 3–4, ball 31 and socket 32 connections, or other similar interlocks known in the art, allow the joining of individual sections of sheet piling to form a continuous steel wall, which may be employed in the construction of bridge piers, cofferdams, bridge abutments, bulkheads or the like. As shown in FIG. 5, flange 16 and web 19 are connected at arcuate junction 20. Similarly, web 19 and flange 18 are connected at arcuate junction 21. Flange 16 is a substantially-planar steel member having a thickness dimension 28. Similarly, web 19 and flange 18 are substantially-planar members with thicknesses dimensions 29 and 30, respectively. Flange 16 and flange 18 are generally parallel to each other. Web 19 transversely connects flanges 16 and 18. However, rather than a perpendicular connection between flanges 16 and 18, web 19 intersects flange 16 at a web angle 22.

Figure 6:
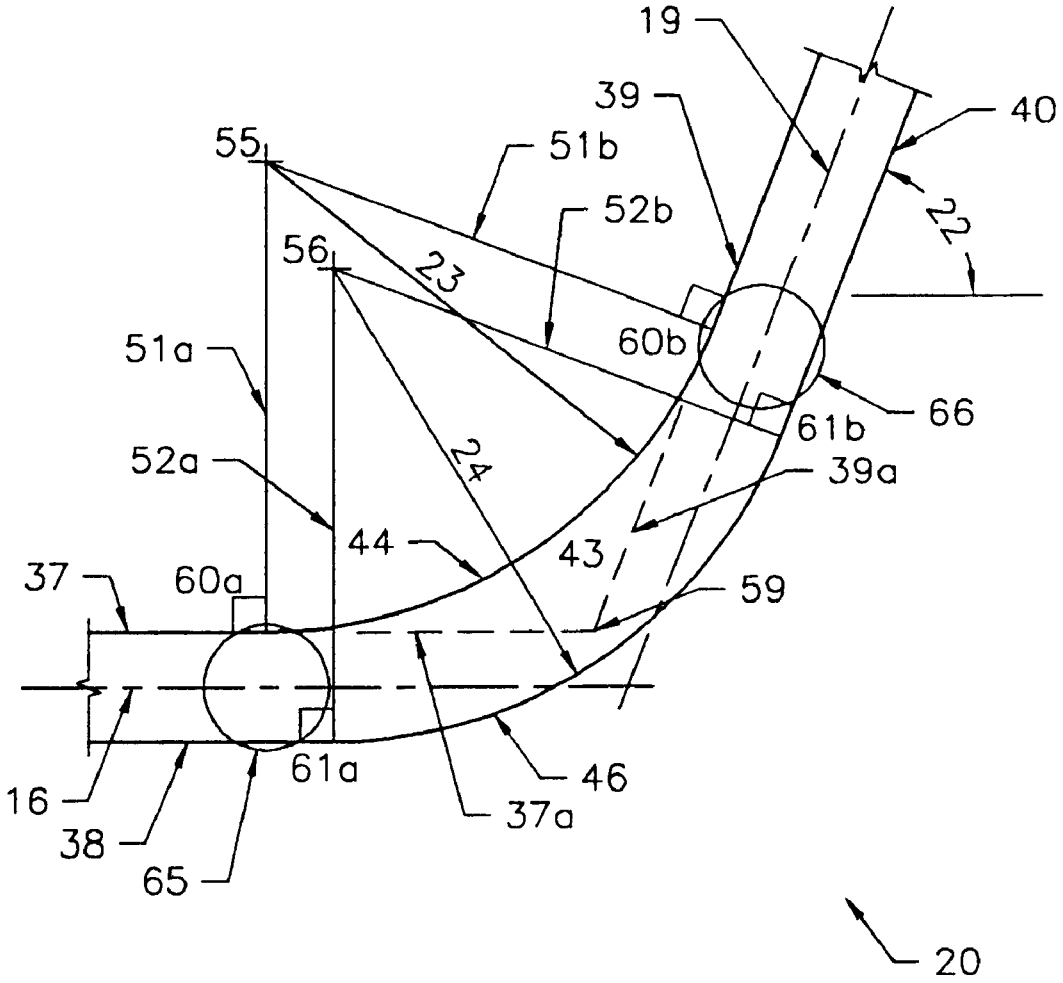
FIG. 6 is an exploded view of the first junction shown in FIG. 5.

As shown in FIG. 6, junction 20 is defined by web angle 22, inner radius 23 and outer radius 24. Junction 20 is the arcuate portion connecting web 19 and flange 16. Flange 16 has substantially parallel inner and outer surfaces 37 and 38. Similarly, web 19 has parallel inner and outer surfaces 39 and 40. Junction 20 has an inner arcuate surface 44 and an outer arcuate surface 46. Inner arcuate surface 44 is generated about a center point 55 and has an inner radius 23. Outer arcuate surface 46 is generated about a center point 56 and has an outer radius 24. Accordingly, surface 44 defines an arc distance of a cylinder having a radius 23 and, similarly, surface 46 defines an arc distance of a cylinder having a radius 24. Center point 55 is located at the intersection of imaginary lines 51*a* and 51*b*. Line 51*a* extends perpendicular to flange surface 37 at tangent point 60*a*. Similarly, line 51*b* extends perpendicular to inner web surface 39 at tangent point 60*b*.

As shown in FIG. 6, the planes of inner flange surface 37 and inner web surface 39 may be extended into junction 20 to imaginary intersection point 59. Arcuate surface 44, the extension of inner web surface 39, and the extension of inner flange surface 37 define fillet 43.

Flange 16 has an outer surface 38 and web 19 has an outer surface 40. Outer surface 38 and outer surface 40 are joined by an arcuate outer surface 46. Center point 56 is located at the intersection of lines 52*a* and 52*b*. Line 52*a* extends perpendicular to flange outer surface 38 at tangent point 61*a* and line 52*b* extends perpendicular to outer web surface 40 at tangent point 61*b*.

Tangent point 60*a* is located at the intersection of surface 37 and arcuate surface 44, which is the point at which the inner surface of flange 16 begins to bend towards inner web surface 39. Similarly, tangent point 60*b* is located at the intersection of surface 44 and surface 39, and tangent points 61*a* and 61*b* are located at the intersections of surface 46 and surfaces 38 and 40, respectively.

Figure 7:
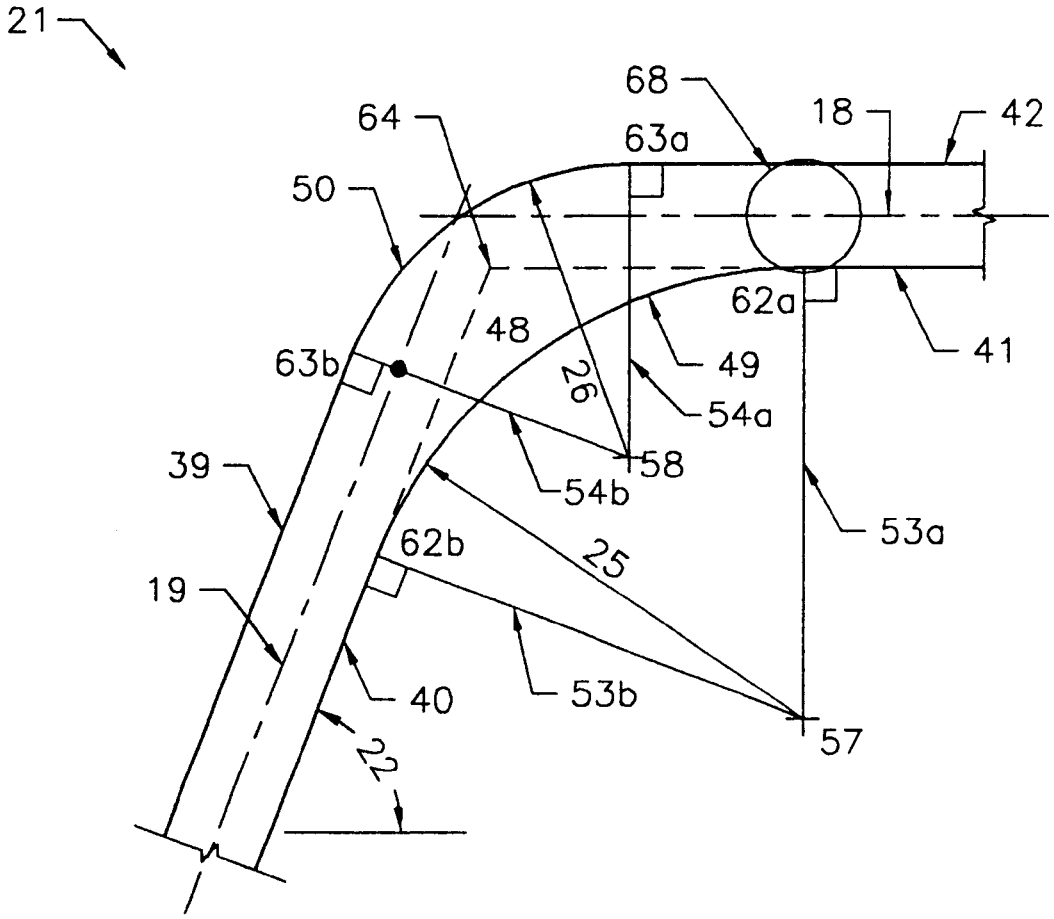
FIG. 7 is an exploded view of the second junction shown in FIG. 5.

As shown in FIG. 7, junction 21 is defined by web angle 22, inner radius 25 and outer radius 26. Junction 21 is the arcuate portion longitudinally connecting web 19 and flange 18. Flange 18 has substantially parallel inner and outer surfaces 41 and 42. Junction 21 has an inner arcuate surface 49 and an outer arcuate surface 50. Inner arcuate surface 49 has a center point 57 and an inner radius 25. Outer arcuate surface 50 has a center point 58 and an outer radius 26. Accordingly, surface 49 defines an arc portion of a cylinder having a radius 25 and, similarly, surface 50 defines an arc portion of a cylinder having a radius 26.

Center point 57 is located at the intersection of lines 53*a* and 53*b*. Line 53*a* extends perpendicularly to flange surface 41 at tangent point 62*a*. Similarly, line 53*b* extends perpendicularly to outer web surface 40 at tangent point 62*b*.

As shown in FIG. 7, the planes of inner flange surface 41 and outer web surface 40 may be extended into junction 21 to intersection point 64. Arcuate surface 49, the extension of outer web surface 40, and the extension of inner flange surface 41 define fillet 48.

Flange 18 has an outer surface 42. Outer surface 42 and inner surface 39 of web 19 are joined by an arcuate outer surface 50. Center point 58 is located at the intersections of lines 54*a* and 54*b*. Line 54*a* extends perpendicular to flange outer surface 42 at tangent point 63*a* and line 54*b* extends perpendicular to inner web surface 39 at tangent point 63*b*.

Tangent point 62*a* is located at the intersection of surface 41 and arcuate surface 49, which is the point at which the inner surface of flange 18 begins to bend towards outer web surface 40. Tangent point 62*b* is located at the intersection of surface 49 and surface 40. Tangent points 63*a* and 63*b* are located at the intersection of surface 50 and surfaces 42 and 39, respectively.

The general configuration for Z-shaped steel sheet pilings is known in the prior art. However, a substantial amount of testing of sections of steel sheet piling was conducted by Applicant to determine whether section modulus alone could be used for the selection and design of sheet piling. From the test results, it was determined that large strength discrepancies exist between different sheet piles with roughly the same section modulus. Analysis of the results illustrates that transverse stresses are much larger in some sheet piling than in others and suggests that transverse stresses had not been properly taken into account in the previous design of Z-shaped sheet piling.

In particular, a testing program was undertaken in which a known PZ27 and a known CZ114 piling section were loaded by water pressure to failure. Strain gauges were installed on the test piling and the stress patterns produced by the testing were examined and analyzed. These stress patterns indicate that transverse (perpendicular to the interlock) stresses exist when the pilings are in use. In some cases, such stresses are larger than the longitudinal bending stresses. Once it was determined that the existing design practice of using section modulus for the piling as the only structuring criteria was inadequate and had to be refined, additional mathematical modeling and analysis was performed to investigate the effects of transverse loading on the behavior of the Z-shaped piling. A technically-reliable analysis method was then formulated to calculate transverse stresses and the calculation for the allowable longitudinal moment ("ML") of the pilings was expanded to include the effect of transverse stresses:

$$M_L = \frac{I}{y}\left(\frac{Fy}{FS} - (Ts)(p)\right)$$

where "Ts" is the transverse stress contribution, "I" is the moment of inertia of the cross section, "y" is the distance from the centroidal axis to the point of calculating the stresses, "Fy" is the yield stress. "FS" is the factor of safety, and "p" is the normal pressure. The "transverse stress contribution" is a value calculated mathematically. The formulation of allowable longitudinal bending moment in the piling is based on use of the Maximum Shear Stress Failure Criterion.

Figure 2:
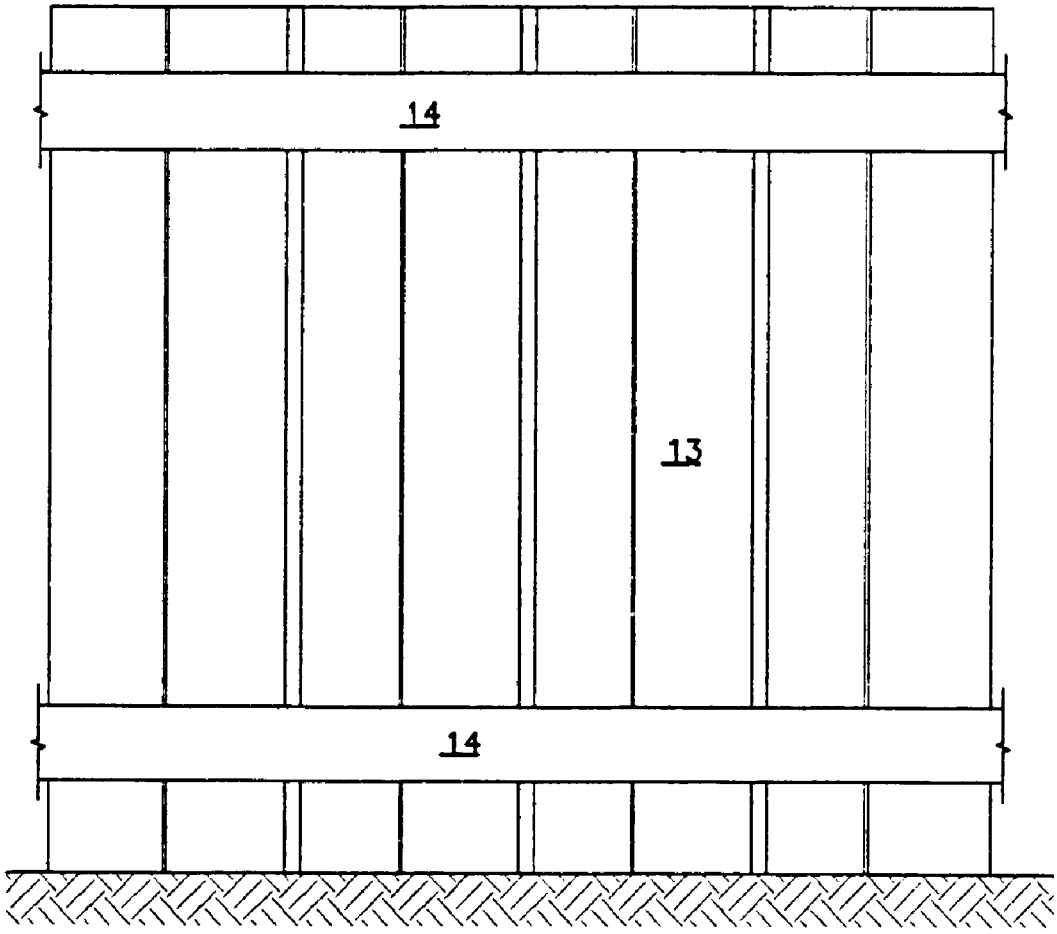
FIG. 2 is a left side elevation of the improved sheet piling shown in FIG. 1.
Figure 9:
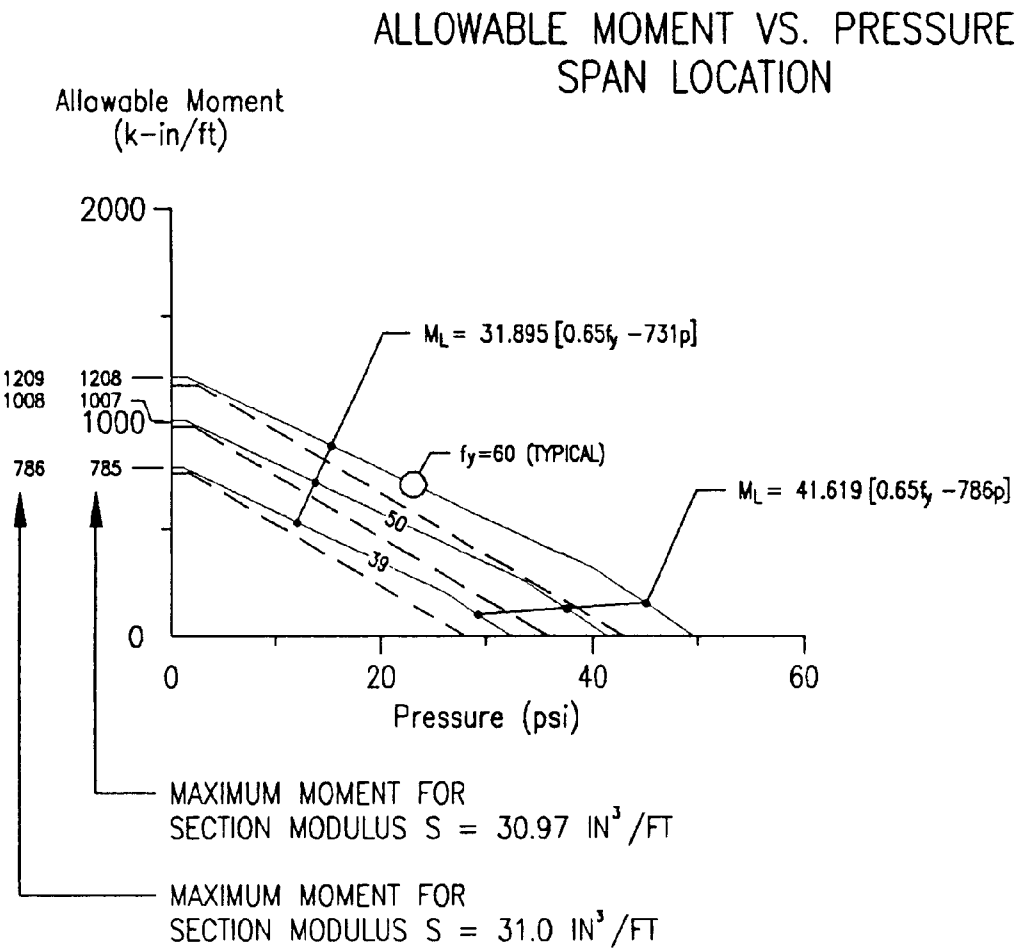
FIG. 9 plots the allowable moment of the improved piling versus applied pressure at the span location.
Figure 10:
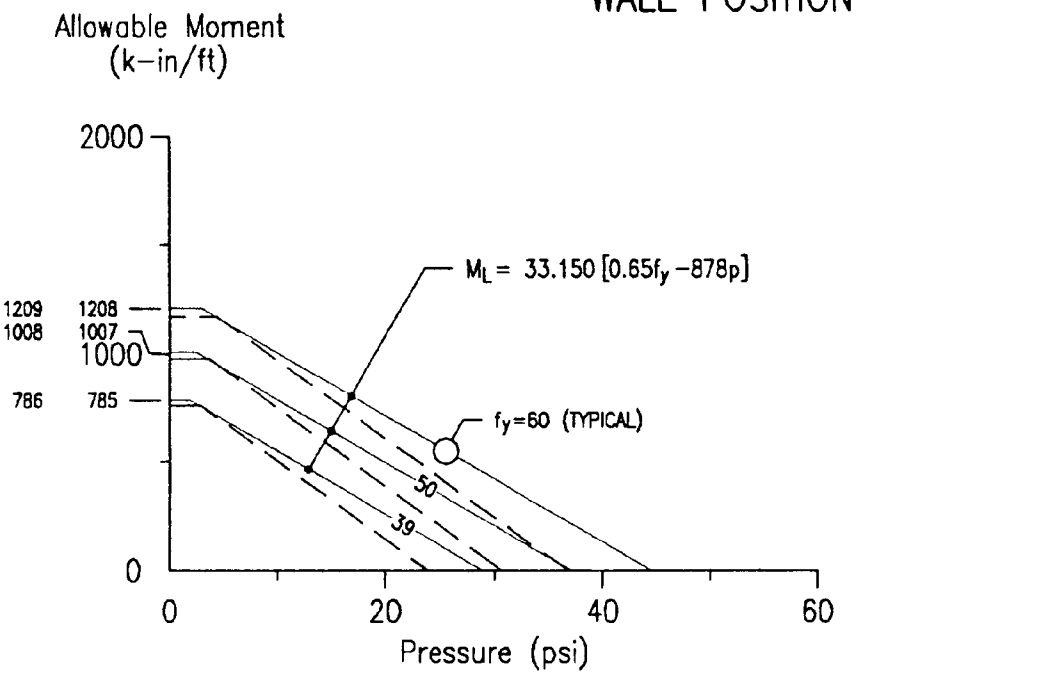
FIG. 10 plots the allowable moment of the improved piling versus applied pressure at the wale location.

FIG. 4 shows the improved sheet piling under loading conditions of one psi oriented normal to the longitudinal surface of the piling. This is the applied pressure load. FIGS. 1–2 show and generally differentiate between wale positions 12 and span positions 13. Wale positions 12 are at those longitudinal points on the piling at which the piling is constrained by a wale 14, and span positions 13 are at those longitudinal points at which the piling is not constrained by a wale 14. FIG. 5 shows wale location 68, low-pressure span location 65 and high-pressure span location 66. During analysis as shown in FIG. 10, it was found that wale location 68 in the preferred embodiment controls the allowable moment of the piling at wale positions 12. The wale location is meant to be that location in the piling which controls the allowable moment of the piling at wale position 12. Similarly, as shown in FIG. 9, it was found that low-pressure span location 65 controls the allowable moment for lower applied pressures at span positions 13 and high-pressure span location 66 controls the allowable moment for higher applied pressures at span positions 13. The span location is meant to be that location in the piling which controls the allowable moment of the piling at span positions 13.

For certain PZ27 sheet pilings known in the prior art, it was discovered that each psi loading stress applied to the piling resulted in 1063 psi of transverse stress at wale position 12. The 1063 psi transverse stress subtracts an equal 1063 psi of allowable stress in the direction of primary load resistance, per the equation:

$$M_L = \frac{I}{y}\left(\frac{Fy}{FS} - 1063p\right)$$

Figure 8:
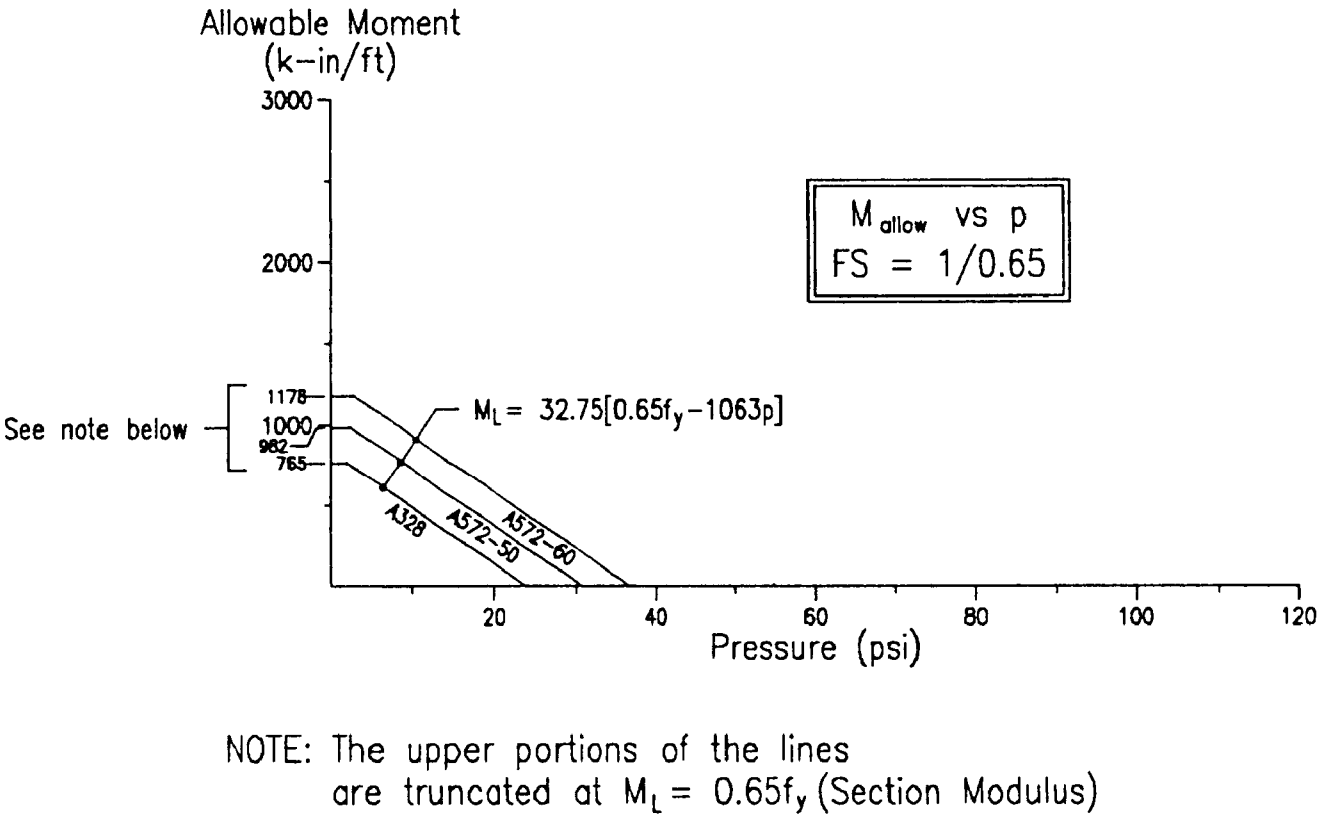
FIG. 8 plots the allowable moment at a wale location of a known PZ27 sheet piling versus applied pressure.

The associated graph of the equation is shown in FIG. 8, with the allowable longitudinal moment on the y axis and pressure on the x axis. The design curve plots the allowable longitudinal moment as a function of pressure for different steel strengths. The pressure is applied normal to the surfaces of the piling. Accordingly, Applicant has discovered that it is highly beneficial to minimize the transverse stresses flowing through the cross-section of the piling.

Using linear finite element analysis, Applicant has developed a new PZ27 sheet piling. The new piling results in a transverse stress of 878 psi at wale location 68 for each psi of applied pressure load. This is a 17.4% reduction in the deleterious stress. The new piling exhibits a transverse stress of 731 psi at span position 13 and low pressure span location 65 for each psi of applied loading stress, and exhibits a transverse stress of 786 psi at span position 13 and high pressure span location 66 for each psi of applied loading stress. At the same time, the improved sheet piling maintains the weight of the piling at approximately 27 psf. The moment of inertia is improved to approximately 188 $in^4$/ft and the section modulus is improved to about 31 $in^3$/ft.

The two graphical depictions shown in FIGS. 9–10 illustrate the substantial increase, due to a reduction in transverse stresses, in the allowable moment as a function of pressure for the improved piling at the span and wale locations, respectively. The broken lines plot the allowable moment versus pressure for a PZ27 piling known in the prior art. The particular piling known in the prior art was manufactured by Bethlehem Steel Corporation and has a first junction inner radius of 1.5 in., a first junction outer radius of 1.0 in., a web angle of 68.8 degrees, a second junction inner radius of 1.5 in., and a second junction outer radius of 1.0 in. The solid lines show the allowable moment for the improved piling.

Structurally, the preferred embodiment of the improved piling has a web angle 22 of 68.8 degrees, a first junction inner radius 23 of 1.75 in., a first junction outer radius 24 of 1.75 in., a second junction inner radius 25 of 1.75 in., and a second outer radius 26 of 1.135 in. First flange thickness 28 and second flange thickness 30 are 0.4 in. and web thickness 29 is 0.375 in. The sheet piling has a moment of inertia of 188.66 $in^4$/ft., a section modulus of 30.97 $in^3$/ft., a weight of 27.56 psf and a cross-sectional area of 12.15 $in^2$. The distance from centroid 69 to first flange outer surface 38 is 5.915 in., and the distance between first flange outer surface 38 and second flange outer surface 42 is 12.006 in. The claimed sheet piling is designed in a manner unknown in the prior art and exhibits characteristics previously unavailable and of great benefit in the construction industry.

Modifications

The present invention contemplates that many changes and modifications may be made. Therefore, while the presently-preferred form of the Z-shaped piling has been shown and described, those skilled in this art will readily appreciate that various additional changes and modifications may be made without departing from the spirit of the invention, as defined and differentiated by the following claims.

What is claimed is:

1. A Z-shaped sheet piling having a first flange, a web, a second flange, a section modulus of at least about 25 $in^3$/ft. and a weight of less than about 31 lbs./$ft^2$, said second flange having a wale location, the improvement comprising:

said web, said first flange and said second flange being so dimensioned and configured that the transverse stress at said wale location for each psi of applied load is less than about 1000 psi.

2. The improvement as set forth in claim 1, wherein said transverse stress at said wale location for each psi of applied load is about 878 psi.

3. The improvement a set forth in claim 1, wherein said section modulus is about 31.0 $in^3$/ft.

4. A Z-shaped sheet piling having a first flange, a web, and a second flange, said first flange having a span location, the improvement comprising:

said web, said first flange and said second flange being so dimensioned and configured that the transverse stress at said span location for each psi of applied load is less than about 800 psi.

5. The improvement as set forth in claim 4, wherein said transverse stress at said span location for each psi of applied load is about 731 psi.

6. The improvement as set forth in claim 4, wherein said transverse stress at said span location for each psi of applied load is about 786 psi.

7. The improvement as set forth in claim 1, wherein said sheet piling has a moment of inertia of about 188.66 in.$^4$/ft.

8. The improvement as set forth in claim 1, wherein said sheet piling has a cross-sectional area of about 12 $in^2$.

9. The improvement as set forth in claim 1, wherein said sheet piling has a weight of about 27.56 psf.

* * * * *